US006604444B1

(12) United States Patent
Belanger et al.

(10) Patent No.: US 6,604,444 B1
(45) Date of Patent: Aug. 12, 2003

(54) LOW MAINTENANCE CUTTING RUBBER

(75) Inventors: James Richard Belanger, Portsmouth, NH (US); Kevin Lauren Cote, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 457 days.

(21) Appl. No.: 09/182,366

(22) Filed: Oct. 29, 1998

(51) Int. Cl.[7] ..... B26D 7/06; B26D 1/26

(52) U.S. Cl. ..... 83/155; 83/117; 83/347; 83/331; 83/435.2

(58) Field of Search ..... 83/658, 663, 679, 83/331, 346, 347, 733, 155, 23, 116, 117, 435.2, 115

(56) References Cited

U.S. PATENT DOCUMENTS

| | | | | | |
|---|---|---|---|---|---|
| 807,420 | A | * | 12/1905 | Copland | 83/331 |
| 1,751,562 | A | * | 3/1930 | Stinger | 83/115 |
| 1,817,037 | A | * | 8/1931 | Mattison | 198/690.2 |
| 3,574,022 | A | * | 4/1971 | Lampert | 156/88 |
| 3,859,879 | A | * | 1/1975 | Spengler | 83/346 |
| 4,385,537 | A | * | 5/1983 | Wolf | 83/155 |
| 4,411,947 | A | * | 10/1983 | Heynhold | 442/228 |
| 4,440,051 | A | * | 4/1984 | Aykut | 83/155 |
| 4,441,390 | A | * | 4/1984 | Hechler et al. | 83/154 |
| 4,811,641 | A | * | 3/1989 | Muller | 83/105 |
| 4,855,174 | A | * | 8/1989 | Kawamoto | 428/67 |
| 4,893,534 | A | * | 1/1990 | Kobler | 83/107 |
| 4,896,765 | A | * | 1/1990 | Loose | 198/847 |
| 4,930,383 | A | * | 6/1990 | Kobler | 83/27 |
| 4,983,155 | A | * | 1/1991 | Stobb | 493/369 |
| 5,103,703 | A | * | 4/1992 | Littleton | 83/155 |
| 5,107,733 | A | | 4/1992 | Palmatier et al. | 83/176 |
| 5,186,444 | A | | 2/1993 | Palmatier et al. | 270/52.5 |
| 5,363,728 | A | * | 11/1994 | Elsner et al. | 83/23 |
| 5,806,392 | A | * | 9/1998 | Cleall et al. | 83/155 |

FOREIGN PATENT DOCUMENTS

| | | | | |
|---|---|---|---|---|
| DE | 716204 | * | 12/1941 | 83/117 |
| GB | 2024081 | * | 1/1980 | 83/117 |

* cited by examiner

*Primary Examiner*—Boyer D. Ashley
(74) *Attorney, Agent, or Firm*—Kenyon & Kenyon

(57) ABSTRACT

The present invention is related to an apparatus for cutting webs of material (1) and includes a cutting cylinder (8) having at least one knife assembly (12, 13) assigned to its circumference (9). A supporting element (23) is assigned to said cutting cylinder (8) forming a cutting region (3) there between and a transport belt (20) having cut rubber portions (20.1, 20.2, 20.3) integrated therein is assigned to said supporting element (23).

13 Claims, 3 Drawing Sheets

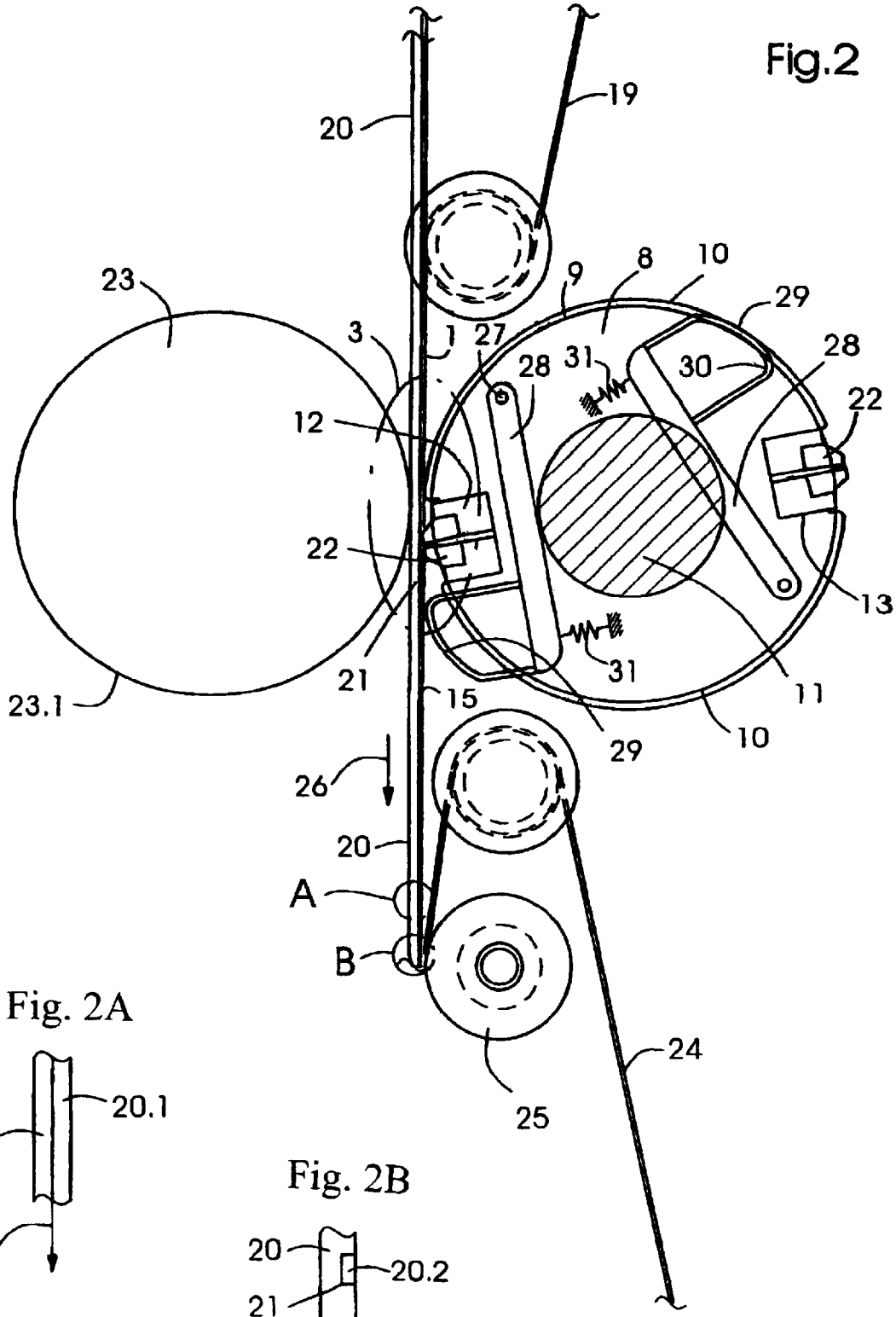
Fig. 2A
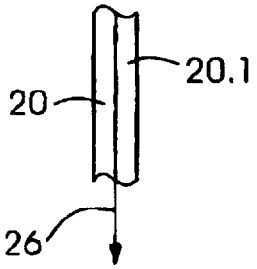
Fig. 2B
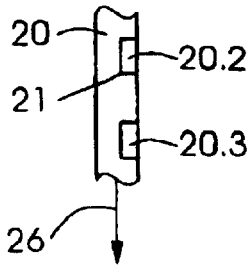

LOW MAINTENANCE CUTTING RUBBER

FIELD OF THE INVENTION

The present invention is related to a cutting rubber assembly which requires low maintenance and which can be used in machines that cut webs of any sort.

BACKGROUND OF THE INVENTION

U.S. Pat. No. 5,107,733 is related to an apparatus for cutting and transporting a paper web in a folding apparatus of a printing press. An apparatus for transporting a web in a printing press comprises a pair of cutting cylinders for cutting web sections from the web, and a transporting device for transporting the web sections away from the cutting cylinders. The first cutting cylinder has at least one cutting angle and the second cutting cylinder has at least one cutting knife which meets the cutting angle at a nip between the cutting cylinders, to cut the web moving through the nip. A plurality of strips are supported on the first cutting cylinder and a plurality of strips are supported on the second cutting cylinder. The strips have positioned on the cutting cylinders in which they impress a temporary reinforcing profile onto each newly formed leading portion of the web, when the strips move through the nip. At least one smoothing surface is supported on the first cutting cylinder and at least one smoothing surface is supported on the second cutting cylinder. The smoothing surfaces have positions on the cutting cylinders, wherein the smoothing surfaces remove the temporary reinforcing profile from the leading portion of the web, when the smoothing surfaces move through the nip.

U.S. Pat. No. 5,186,444 concerns a method and device for assuring orderly web travel in a folder by punching holes in a paper width direction.

A method of assuring orderly web travel in a folder includes stamping out of a layer structure formed of mutually superimposed web surface portions, along respective strips thereof, a plurality of tongue-like elements remaining appendant to the web surface portions and projecting through respective holes simultaneously stand out of the web surface portions, so as thereby to hold the web surface portions together at the respective strips thereof and a device for performing the method.

The known devices according to the prior art have anvil bars which are assigned to lateral grooves of the anvil cylinders. Once said anvil bars consisting essentially of rubber are worn out, they have to be exchanged. Maintenance regarding the exchange of anvil bars on cutting cylinders requires considerable down time of the press. Further, the accessibility of said anvil bars is difficult.

A further disadvantage of the rectangular shaped anvil bars known from the art is that they constrain the signature on impact of the knife and cheekwood of the assembly upon the cutting operation only. Prior to and after the cut operation a signature constraint cannot be achieved with device known from the art.

SUMMARY OF THE INVENTION

In view of the prior art cited it is an object of the present invention to reduce the maintenance of cutting rubbers.

A further object of the present invention is to improve the constraint on the signature as it is created.

According to the present invention, an apparatus for cutting webs of material includes:

- a cutting cylinder having at least one knife assembly assigned to its circumference,

- a supporting element assigned to said cutting cylinder forming a cutting region there between, and
- a transport belt having integrated cut rubber portions, said transport belt being assigned to said supporting element.

The present invention offers the advantage to index said belt upon wear of the cut rubber spot to a fresh cut rubber spot or portion, respectively. When there are no more fresh spots, the entire belt can be replaced very easily. Furthermore, a constraint is exerted upon the incoming web and the signature resulting there from over the entire length of the cutting region, prior to the cutting region and behind the cutting region.

According to further details of the present invention, said transport belt travels along an endless loop about said supporting element which may be designed as an anvil cut roller or cylinder with a smooth surface. Said revolving transport belt co-operates with an upper web transport device prior to the cutting region as well as with a lower signature transport device. Said transport belt is substantially supported by a supporting element within said cutting region, i. e. upon its section of the travel path opposite said knife cylinder. Said transport belt having cut rubber portions assigned thereto, bridges the distance between said upper web transport device and said lower signature transport device. The width of said transport belt corresponds to the maximum width of the web to be processed in a folder apparatus arranged behind a rotary printing press.

On the transport belt a laminated cut rubber layer may be provided, the cut rubber layer traveling with the transport belt about its closed loop. Upon wearing of a spot of the laminated cut rubber layer, the transport belt is indexed, so that a new spot of the respective cut rubber layer co-operates with respective knife assemblies upon a cutting operation. As an alternative, distinct cut rubber portions may be integrated into the transport belt received in lateral grooves assigned to said transport belt. Upon the occurrence of a cut operation, said spot of the cut rubber layer or said distinct cut rubber portions received by a lateral groove are supported by said supporting element, being an anvil roller having a smooth surface for instance.

Along the entire surface of said transport belt adjacent cut rubber portions may be arranged so as to provide several fresh cutting anvils which are easy to replace upon wear.

The present invention further discloses a method for severing signatures from an incoming web of material comprising the steps of

- constraining an incoming web of material between a transport belt and a signature transport device,
- supporting said transport belt having cut rubber portions integrated therein by a supporting element upon impact of a knife assembly, and
- constraining the severed signature between a portion of said transport belt and a signature transport device upon further travel of the severed signature in signature travel direction.

BRIEF DESCRIPTION OF THE DRAWINGS

The novel features which are considered as characteristic for the present invention are set forth in particular in the appended claims. The present invention itself, however, both as to its construction and its method of operation together with additional objects and advantages thereof will be best understood from the following description of a specific embodiment when read in connection with the accompanying drawings in which:

FIG. 2 shows a transport belt having cutting rubber portions assigned thereto, shown in regions A and B; and FIGS. 2A and 2B show the regions A and B of FIG. 2 in greater detail.

DETAILED DESCRIPTION OF PREFERRED EMBODIMENTS

Figure 1:
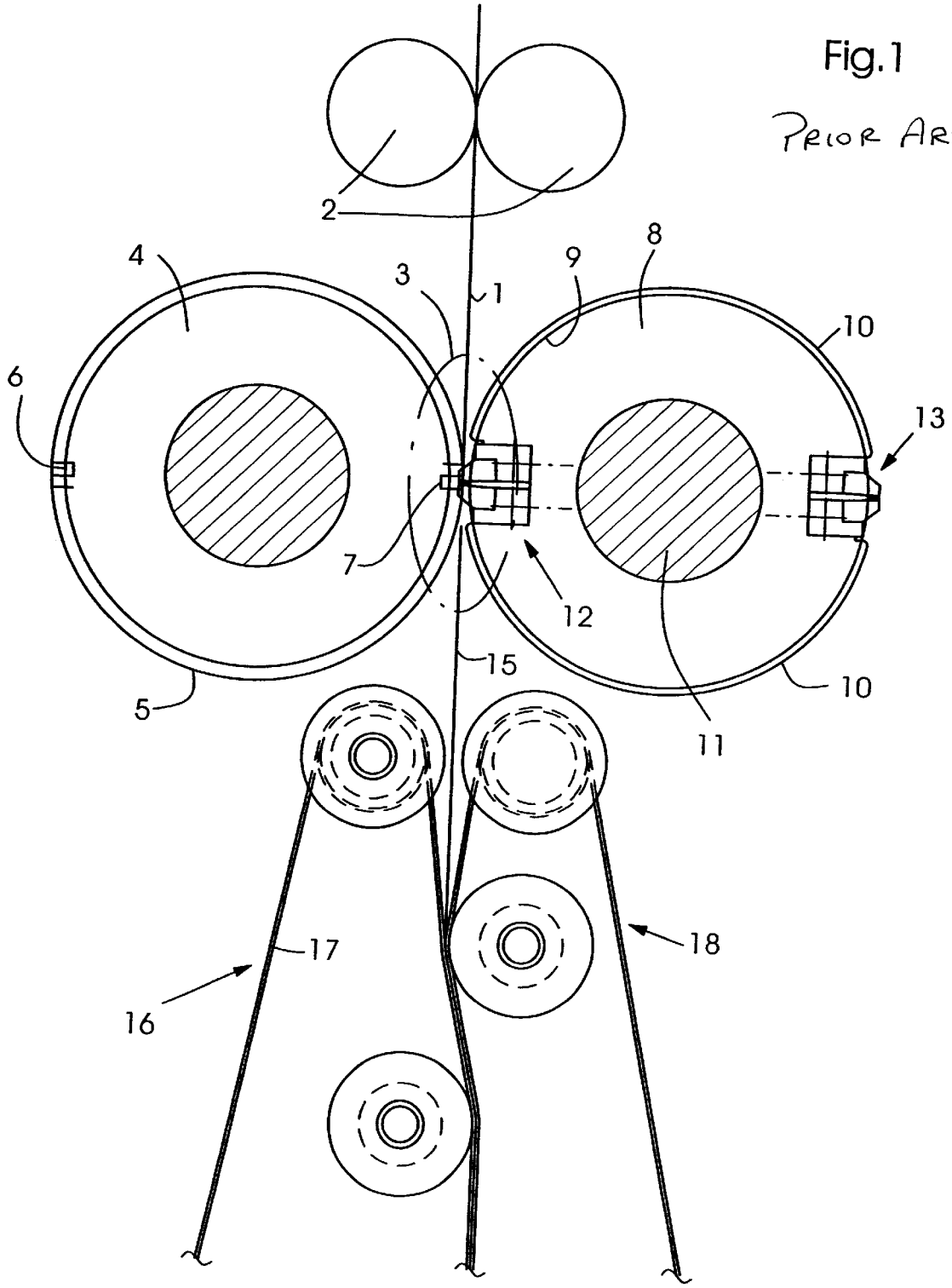
Fig. 1 PRIOR ART
FIG. 1 shows an existing cutting cylinder pair design, the anvil cylinder having anvil bars assigned thereto.

FIG. 1 shows an existing cutting cylinder pair design with the anvil cylinder having anvil bars assigned thereto.

An incoming web of material 1 is forwarded into a cutting region 3 by a pair of nip rollers 2 arranged above a cutting cylinder pair, including an anvil cylinder 4 and a knife cylinder 8. Knife cylinder 8 includes two knife assemblies, a first knife assembly 12 and a second knife assembly 13. Between said first and second knife assembly 12, 13, respectively, surface jackets 10 are assigned to the circumference 9 of said knife cylinder 8. Said first and second knife cylinder assemblies 12, 13, respectively, are arranged opposite to one another, thus severing two signatures from the incoming web of material 1 upon a complete revolution. Said anvil cylinder 4 has two rectangularly shaped anvil bars, a first anvil bar 6 and a second anvil bar 7 cooperating with said first and second knife assemblies 12, 13 respectively, of said knife cylinder 8. Said first and second anvil bars 6, 7 respectively, are arranged opposite to one another. Within a cutting region 3 signatures 15 are severed from said incoming web of material 1, said signatures 15 being transferred to a transporting system including a left transport system 16 and a right transport system 18. Both transport systems 16, 18, respectively, have revolving belts 17 assigned thereto for further transportation of said signatures 15, continuously severed from the incoming web of material 1 in said cutting region 3.

FIG. 2 shows a transport belt having rubber portions assigned thereto, while FIGS. 2A and 2B show the regions A and B respectively of FIG. 2 in greater detail.

According to the present invention, above a knife cylinder 8 constraining tapes 19 are arranged which cooperate with a transport belt 20. Said transport belt 20, extending over the width of said knife cylinder 8, corresponds in its width to the maximum width of the web of material 1 to be processed in a folding apparatus, for example. Said transport belt 20 travels along an endless loop, not shown in greater detail here and substantially extends in its vertical path from said constraining tapes 19 through said cutting region 3 to a signature its vertical path from said constraining tapes 19 through said cutting region 3 to a signature transporting device 24 arranged below said knife cylinder 8. As previously has been mentioned, two knife assemblies 12, 13, respectively, are assigned to the circumference 9 of said knife cylinder 8 opposite to one another. Besides the knifes for severing a signature 15 from the incoming web of material 1, said knife assemblies 12, 13 comprise cheekwoods 22 for securing said knifes to the respective knife assembly 12, 13, respectively. Still further, cams 28 are arranged within said knife cylinder 8, which are mounted pivotally about respective axes 27. Said axes 27 extend substantially through the interior of said knife cylinder 8. Said cams 28 each comprise a cam surface 29 including a respective contacting portion 30. Further, said cams 28 are connected to spring means 31 retracting said cams 28 into its respective disengaged position within circumferential grooves of said knife cylinder 8. In its engaged position said cams 28 contact with respective contacting portions 30 trailing edges of cut signatures 15 leaving said cutting region 3. It can be derived from Fig. 2 of the present application that said cam surfaces 29 penetrate said surface 9 of said knife cylinder in the respective section of the cylinders surface 9 below said respective knife assembly 12, 13, respectively. Said contacting portions 30 exactly will seize the trailing edge of cut signature 15 once this signature 15 has left the cut region 3, i. e. a constraint on the signature 15 is exerted upon leaving the cutting region 3.

Opposite said knife cylinder 8, a revolving supporting element 23 is arranged, having a substantially flat surface on its circumference 23.1. Said supporting element 23 supports said transport belt 20 upon a cutting operation in the cutting region 3 and supports the new formed leading edge of said incoming web of material 1 until the next cutting operation occurs. The cut signature 15 is forwarded to a signature transporting device 24 cooperating with said transport belt 20 travelling in direction 26 of signature travel.

The operation of the improved design according to the present invention will be described in greater detail below.

An incoming web of material 1 to be processed will be seized between said transport belt 20 and said constraining tapes 19 prior to said region 3. A leading edge of said incoming web 1 will pass the cutting region 3 until the next knife assembly 12 or 13 will approach the cutting region 3 travelling on said circumference 9 of said knife cylinder 8. Since the cutting operation requires an anvil counter part to perform a distinct precise cut of a web of material or a package of a multilayered web ribbon, upon a cut, said transport belt 20 is supported by revolving supporting element 23, such as an anvil roller or an anvil cylinder. Said supporting element 23 is provided with a flat surface 23.1 and is intended to support the transport belt 20 upon the occurrence of a cutting operation. However, the counter part for the cutting operation, i. e. the cut rubber contacting the tip of the knife, is integrated into said transport belt 20. FIGS. 2A and 2B show two more detail of the areas A and B in FIG. 2, and thus show two possible alternatives for the structure of the belt 20.

FIG. 2A shows said transport belt 20 having a rubber layer 20.1 laminated thereto and said transport belt 20 travelling in signature travel direction 26. A spot of said cut rubber layer 20.1 will form the respective counter part or anvil for a respective tip of a knife of said knife assemblies 12 and 13, respectively, assigned to said circumference 9 of said knife cylinder 8. In a second embodiment said transport belt 20 comprises lateral extending grooves 21 each receiving cut rubber portions 20.2 and 20.3 as shown in FIG. 2B. Again, said transport belt 20 moves into signature travel direction indicated by arrow 26. In the second orientation shown in FIG. 2B, the drive of said transport belt 20 may be synchronized such that upon occurrence of a cutting operation a respective one of said cut rubber portions 20.1, 20.3 respectively is arranged opposite the approaching knife assembly 12, 13, respectively, performing a cut and severing a respective signature 15 from the web of material.

Upon severing of a signature 15 from the incoming web of material 1, said signature 15 upon further travel through said cutting region 3 is supported by said transport belt 20, traveling in signature conveying direction 26. Thus, upon further travel of the cut signature 15, the constraint on the signature 15 is improved by having said contacting surfaces 29 of the respective cams 28 contact said leading edge of the cut signatures 15. Thus, upon further travel of said cut signature 15 to said further transport device 24, said cut signatures are seized upon transport. Said cut signature 15 will be seized between said transport belt 20 and a revolving seizing or transport belt 24 of said signature transport device downstream of said cutting region 3 after said contacting surfaces 30 have released the respective trailing edge of said cut signature 15. Said cams 28 are actuated by mechanical cam followers, an air or hydraulic cylinder, by means of electronic solenoids, stepper motor, magnetic flux, or an inflatable bladder. Said transport device 24 may include a deviation roller 25, only schematically given in FIG. 2 of the present application.

Suitable materials for said laminated cut rubber layer 20.1 or the shaped cut rubber portions 20.2, 20.3 are materials such as urethane or polyurethane.

Said revolving transport belt 20 may include said cut rubber portions 20.2 and 20.3, respectively, arranged adjacent to one another across the entire length of said transport belt 20. Said laminated cut rubber layer 20.1 shown in FIG. 2A is provided along the entire length of said transport belt 20. If, after numerous cutting cycles, the respective spot of the laminated cut rubber layer 20.1 is worn out, the transport belt 20 will be indexed to arrange a fresh spot vis-a-vis the respective knife of the knife assemblies 12, 13, respectively. With the embodiment of FIG. 2B, if the transport belt 20 has worn out rubber portions 20.2, 20.3 assigned to lateral grooves 21, said transport belt 20 will be indexed to the next available fresh cut rubber portion 20.2, 20.3.

Thus, maintenance is reduced to an indexing operation to be performed on said transport belt 20, once the cutting quality becomes insufficient. An entire replacement of said transport belt 20 according to the present invention will be due only after many indexing operations. In the designs according to the prior art, a replacement of the rectangular shaped anvil bars directly assigned to the anvil cylinder causes considerable downtime of the machine.

Figure 3:
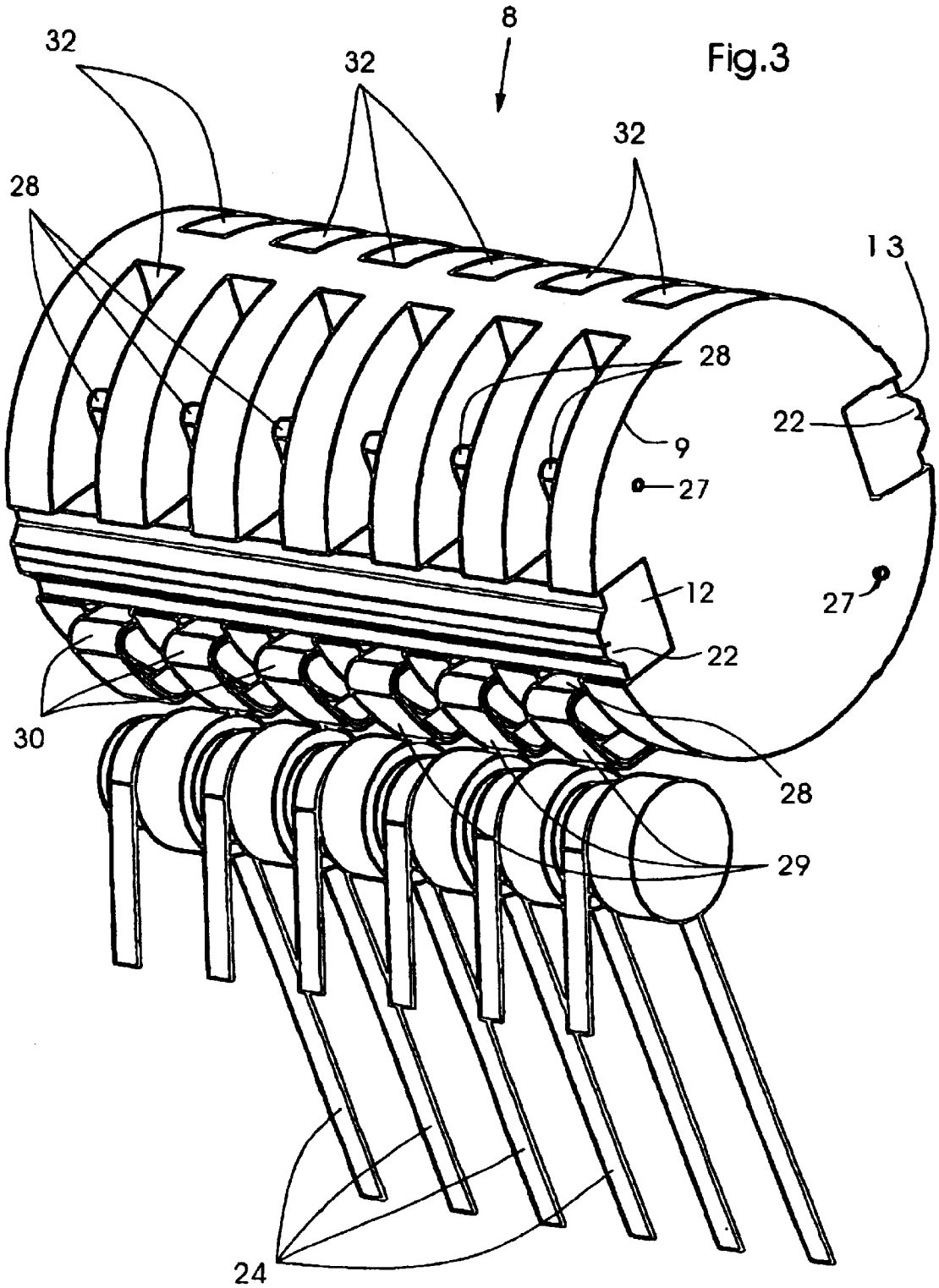
FIG. 3 shows a 3-dimensional view of a cutting cylinder having a plurality of cams integrated therein.

FIG. 3 of the present application disclose a 3-dimensional view of a knife cylinder 8 according to the present invention.

Across the width of said knife cylinder 8 a plurality of circumferential grooves 32 is provided in which said pivotally mounted cams 28 are arranged. Said cams 28, each having a cam surface 29 and a respective contacting portion 30 are mounted such that said cam surfaces 29 penetrate a respective surface 9 of said knife cylinder 8 below said knife assemblies 12, 13 respectively. As can be derived from the perspective view given in FIG. 3, said contacting portions 30 of said cam surfaces 29 interlace with said belt roller about which said belts 24 rotate. For reasons of clarity said transport belt 20 is not shown in the perspective view of said knife cylinder 8 according to FIG. 3. Across the width of said knife cylinder 8 a pivot axis 27 extends about which said cams 28 are rotatably mounted. Said knife assemblies 12, 13, respectively each comprise a knife extending parallel to the axis of rotation of said knife cylinder 8. Said knife is mounted between two cheekwoods 22 of the respective knife assemblies 12, 13.

List of Parts

1 incoming web
2 pair of nip rollers
3 cutting region
4 anvil cylinder
5 anvil cylinder surface
6 first anvil bar
7 second anvil bar
8 knife cylinder
9 circumference
10 surfacejacket
11 axis of rotation
12 first knife assembly
13 second knife assembly
15 cut signature
16 left transport system
17 belt
18 right transport system
19 constraining tapes
20 transport belt
20.1 cut rubber layer
20.2 cut rubber portion
20.3 cut rubber portion
21 cut rubber groove
22 cheekwood
23 supporting element
23.1 supporting element circumference
24 belt
25 deviation roller
26 direction of signature travel
27 pivot axis
28 cam
29 cam surface
30 contacting portion
31 spring means
32 circumferential groove

What is claimed is:

1. Apparatus for cutting a web of material comprising:

a knife cylinder having a circumference, the knife cylinder having at least one knife assembly located on the circumference;

a supporting element located adjacent to the knife cylinder, a cutting region being formed between the supporting element and the knife cylinder;

a transport belt having integrated cut rubber portions, the transport belt supported by the supporting element; and a cam for contacting cut signatures emerging from the cutting region, the cam being pivotably mounted to the knife cylinder.

2. The apparatus according to claim 1 wherein the transport belt travels along an endless loop around the supporting element.

3. The apparatus according to claim 1 further comprising a lower signature transport device, the transport belt co-operating with the lower signature transport device.

4. The apparatus according to claim 1 wherein a width of the transport belt corresponds to a maximum width of the web to be cut.

5. The apparatus according to claim 1 further comprising a continuous cut rubber layer laminated to the transport belt, the transport belt traveling about an endless loop.

6. The apparatus according to claim 1 wherein the supporting element is a cutting anvil roller supporting the web upon cutting by the at least one knife assembly.

7. The apparatus according to claim 1 wherein the cam includes cam surfaces oriented towards the transport belt.

8. The apparatus according to claim 1 wherein the cam includes contacting portions seizing a respective trailing edge of the cut signatures upon conveyance of the cut signatures from the cutting region towards a transport device.

9. The apparatus according to claim 1 further comprising an upper web transport device, the transport belt co-operating with the upper web transport device.

10. The apparatus according to claim 9 wherein a distance between the upper web transport device and a lower signature transport device is bridged by the transport belt.

11. The apparatus according to claim 1 further comprising distinct cut rubber portions integrated into the transport belt.

12. The apparatus according to claim 11 wherein the cut rubber portions are received in lateral grooves in the transport belt.

13. The apparatus according to claim 11 wherein the cut rubber portions are adjacent to one another along an entire length of the transport belt.

* * * * *